US006737389B1

(12) United States Patent
Kuzee et al.

(10) Patent No.: US 6,737,389 B1
(45) Date of Patent: May 18, 2004

(54) METHOD FOR TREATING TEXTILE

(75) Inventors: Hendrika Cornelia Kuzee, CB Oost-Souburg (NL); Henricus Wilhelmus Carolina Raaijmakers, HD Roosendaal (NL); Mariette Ellen Boukje Bolkenbaas, AA Oosterland (NL); Antonius Jacobus Gerardus Maria Kaarsgaren, KD Ede (NL); Johannes Kooi, BA Beers (NL); Hildegonda Petronella Maria Fliervoet, VD Ede (NL)

(73) Assignee: Coöperatie Cosun U.A., Breda (NL)

( * ) Notice: Subject to any disclaimer, the term of this patent is extended or adjusted under 35 U.S.C. 154(b) by 0 days.

(21) Appl. No.: 09/719,144

(22) PCT Filed: Jun. 10, 1999

(86) PCT No.: PCT/NL99/00361

§ 371 (c)(1),
(2), (4) Date: Mar. 30, 2001

(87) PCT Pub. No.: WO99/64551

PCT Pub. Date: Dec. 16, 1999

(30) Foreign Application Priority Data

Jun. 10, 1999 (NL) ..... 1009368

(51) Int. Cl.[7] ..... C11D 3/22

(52) U.S. Cl. ..... 510/287; 510/276; 510/310; 510/398; 510/470; 510/471; 510/477

(58) Field of Search ..... 510/276, 287, 510/310, 398, 470, 471, 477

(56) References Cited

U.S. PATENT DOCUMENTS 5,326,864 A * 7/1994 Besemer et al. ..... 536/123.1

5,777,090 A * 7/1998 Verraest et al. ..... 536/4.1

FOREIGN PATENT DOCUMENTS

| | | |
|---|---|---|
| WO | WO 91/17189 | 11/1991 |
| WO | WO 98/25972 | 6/1998 |

OTHER PUBLICATIONS

Verraest, D.L., et al., Oxidation and caboxymethylation of sucrose and inulin, Symposium of Association A.v.H., Reims, 120 (1995), Nr. 9, pp. 799–803. XP 002037421.

* cited by examiner

*Primary Examiner*—Charles Boyer
(74) *Attorney, Agent, or Firm*—Muserlian, Lucas & Mercanti, LLP

(57) ABSTRACT

A next textile treatment where the present method can be used to remove contaminants from the textile concerns rewashing. As already observed above, after dyeing textile with reactive dyestuffs, a considerable amount of dyestuff, particularly hydrolyzed dyestuff, is left behind on the textile. Because the hydrolyzed dyestuff is not fast to washing, it should be removed to provide a textile with sufficient washing fastness. In a rewashing treatment of textile dyed with reactive dyestuff, the textile is first rinsed with water to remove alkali and salt. Thereupon, it is rewashed, with the fructan polycarboxylic acid being metered in the form of a 25–40% solution in an amount of 1–3 g/l of water. Rewashing preferably takes place at a temperature of 95–100° C. for a period of 10–30 minutes. After rewashing, the textile is again rinsed with water to remove residues of the hydrolyzed reactive dyestuff. When the textile has been given a very dark color with a reactive dyestuff, it may be necessary to repeat the rewashing treatment.

15 Claims, No Drawings

METHOD FOR TREATING TEXTILE

This application is a 371 of PCT/NL99/00361 dated Jun. 10, 1999.

This invention relates to a method for treating textile and more particularly to a method for removing contaminants from textile.

In the textile processing industry, it is usual to process raw materials whose origin is not precisely known. Cotton and wool, for instance, are often purchased in the form of semimanufactured products which still contain various contaminants. In the case of cotton, those contaminants often consist of particles, such as sand and small plant remains, pigment particles and residues of plant protection agents and defoliants. In wool, the contaminants referred to can consist of soil or sand, or feces, urine, sweat, and greases (lanolin) originating from the animal from which the wool is derived.

As the textile processing industry often does not know of each batch of textile semimanufactured product which contaminants are present in it, the aim is to have processes available that are as universal as possible and by which different kinds of contaminants can be removed in a single step. In practice, for this reason, textile is normally treated with a composition comprising a polyacrylate.

A disadvantage of the known compositions based on polyacrylates is that polyacrylates are hardly, if at all, biodegradable. These substances are discharged along with the washing water used in the treatments. When the waste water is processed in a water purification plant, the polyacrylates end up in the sludge left, and thus end up in the environment.

It is an object of the invention to provide a method for treating textile, whereby contaminants are removed in an efficient manner and whereby the environment is not unacceptably burdened.

Surprisingly, it has now been found that the use of certain specific fructan polycarboxylic acids leads to a highly efficient, environment-friendly removal of contaminants from textile. Accordingly, the invention relates to a method for removing contaminants from textile, wherein the textile is treated with a fructan polycarboxylic acid which contains on average at least 0.05 carboxyl groups per monosaccharide unit.

It is of great advantage in a method according to the invention that the materials used are biodegradable. The fructan polycarboxylic acids used according to the invention have the property that they are broken down within a relatively short time to substances that are preferably water-soluble and non-toxic. The decomposition can occur inter alia by hydrolytic splitting, under the influence of light, air, water and/or microorganisms occurring in nature. Because of this property, the materials are designated by the term biodegradable materials.

In addition, it has been found that with the use of I the present fructan polycarboxylic acids, an attractive alternative to the conventionally used polyacrylates is also being offered as regards the effectiveness in the removal of contaminants.

As stated, according to the invention, textile is treated with a fructan polycarboxylic acid which contains on average at least 0.05 carboxyl groups per monosaccharide unit. Depending on the nature of the fructan polycarboxylic acid, the number of carboxyl groups per monosaccharide unit of the fructan polycarboxylic acid can be expressed in the total degree of substitution of carboxyl groups (DS) or the total degree of oxidation (DO). Preferably, the fructan polycarboxylic acid to be used contains between 0.5 and 3 carboxyl groups per monosaccharide unit. It will be clear that it is also possible according to the invention to use mixtures of different fructan polycarboxylic acids.

A fructan polycarboxylic acid is understood to mean any oligo- or polysaccharide that contains a plurality of anhydrofructan units and which has been converted into a polycarboxylic acid. The fructans on which a fructan polycarboxylic acid can be based can have a polydisperse chain length distribution and can have a linear or branched chain. Preferably, the fructans contain mainly β-1,2 bonds, as in inulin, but they may also contain β-2,6 bonds, as in levan. Suitable fructans can originate directly from a natural source, but may also have undergone a modification. Examples of modifications in this connection are reactions, known per se, which lead to a lengthening or shortening of the chain length. Suitable fructans have an average chain length (degree of polymerization, DP) of at least 2, up to about 1,000. Preferably, a fructan is used having a degree of polymerization of at least 3, more preferably at least 6, most preferably at least 10, up to about 60.

Fructans on which a fructan polycarboxylic acid can be based for use in a method according to the invention include, in addition to naturally occurring polysaccharides, industrially prepared polysaccharides, such as hydrolysis products, which have shortened chains, and fractionated products having a modified chain length, in particular a chain length of at least 10. A hydrolysis reaction for obtaining a fructan having a shorter chain length can be carried out enzymatically (for instance with endoinulinase), chemically (for instance with aqueous acid), physically (for instance thermally) or by the use of heterogeneous catalysis (for instance with an acid ion exchanger). Fractionation of fructans, such as inulin, can be accomplished, for instance, by crystallization at low temperature, separation with column chromatography, membrane filtration, and selective precipitation with an alcohol. Other fructans, such as fructans having a long chain, can be obtained, for instance, by crystallization, from fructans from which mono- and disaccharides have been removed, and fructans whose chain length has been enzymatically extended can also serve as a basis for a fructan polycarboxylic acid that is used in the present method. Further, reduced fructans can be used. These are fructans whose reducing terminal groups, normally fructose groups, have been reduced, for instance with sodium borohydride or hydrogen in the presence of a transition metal catalyst. Also eligible for use are fructans which have been chemically modified, such as crosslinked fructans and hydroxyalkylated fructans.

In a preferred embodiment, the fructan polycarboxylic acid which is used according to the invention is based on inulin. Inulin is a polysaccharide consisting of β-1,2 bound fructose units with an α-D-glucopyranose unit at the reducing end of the molecule. The substance occurs inter alia in the roots and tubers of plants of the Liliaceae and Compositae families. The most important sources for the production of inulin are Jerusalem artichoke, dahlia and chicory root. In the industrial production of inulin, the starting material is mainly chicory root. The principal difference between inulins originating from the different natural sources resides in the degree of polymerization, which may vary from about 6 in Jerusalem artichokes to 10–14 in chicory roots and higher than 20 in dahlias. According to the invention, it is preferred to use a fructan polycarboxylic acid having a degree of polymerization of 9–11.

The derivatives of inulin used according to the invention are polycarboxylates. Known suitable polycarboxylate derivatives of inulin are dicarboxy inulin, obtained, for instance, by glycolytic oxidation of inulin, 6-carboxy-inulin, obtained, for instance, by selective oxidation of the primary hydroxyl groups of inulin (TEMPO oxidation), carboxymethyl inulin, carboxyethyl inulin, obtained, for instance, by cyanoethylation followed by hydrolysis. Derivatives of inulin which are preferably used are dicarboxy inulin, carboxymethyl inulin and carboxyethyl inulin.

Particularly suitable fructan polycarboxylic acids for use in a method according to the invention are further fructan polycarboxylic acids that contain both carboxyl groups obtained by oxidation of carbon atoms forming part of the anhydrofructose units in the molecule, and carboxyl groups obtained by attachment of carboxyalkyl or carboxyacyl groups to the anhydrofructose units. It has been found that these twofold modified compounds are more suitable for removing contaminants from textile than may be expected on the ground of the combination of, for instance, dicarboxy inulin and carboxymethyl inulin.

The twofold modified fructan polycarboxylic acids mentioned can be prepared by oxidizing a fructan in a known manner, followed by carboxyalkylation or carboxyacylation of the oxidation product in a known manner. It is also possible to change this order around and to have carboxyalkylation or carboxyacylation precede oxidation. The carboxymethylation can be carried out, for instance, with sodium monochloroacetate in water at a pH of 10–13, or with another haloacetic acid derivative. Dicarboxymethylation can be carried out in a comparable manner, for instance by reaction with a halomalonate ester, followed by hydrolysis. Carboxyacylation can be carried out with an anhydride or another reactive derivative of a polycarboxylic acid, such as succinic acid or maleic acid anhydride. The oxidation can be carried out in different ways, for instance utilizing hypohalite, periodate/chlorite or hydrogen peroxide, which in each case leads mainly to dicarboxyl groups ($C_3$–$C_4$ cleavage), or utilizing hypochlorite/TEMPO, which leads to monocarboxyl groups ($C_6$ oxidation). Oxidation whereby $C_3$–$C_4$ cleavage occurs is preferred.

If a fructan is first carboxyalkylated or carboxyacylated, and then oxidized, the DS after this first step is preferably not higher than 1.2, so that sufficient reactive sites are left in the fructan for the oxidation. When subsequently a $C_6$ oxidation is carried out, the carboxyalkylation or carboxyacylation can be allowed to proceed to a higher DS, for instance to a DS of 2.0.

Preferably, the fructan is first oxidized, for instance to a DS of at least 0.2, preferably to a DS between 0.5 and 2.0 (25–100% oxidation in the case of $C_3$–$C_4$ oxidation). The oxidized product is thereupon carboxyalkylated or carboxyacylated, for instance to a DS between 0.2 and 1.8, preferably to a DS between 0.5 and 1.6. If desired, the solution obtained after oxidation can be concentrated, so that the efficiency of the carboxyalkylation or carboxyacylation is increased. This leads to products where the carboxyalkyl or carboxyacyl groups are present in larger numbers at the positions of primary hydroxyl groups ($C_6$ in inulin and $C_1$ in levan) than under normal conditions in carboxyalkylated or carboxyacylated fructans. This means that at least 30%, preferably at least 40%, of the carboxyalkyl or carboxyacyl groups are present on primary carbon atoms.

In many cases, it is advantageous to use as starting material a fructan from which the reducing units have been removed through treatment with a reducing agent, such as sodium borohydride or hydrogen in combination with a transition metal catalyst. According to this preferred embodiment, a fructan polycarboxylic acid for the present use can be suitably prepared by reducing first, then oxidizing, followed by carboxyalkylation or carboxyacylation, and finally purifying.

Wherever in this text and the appended claims reference is made to carboxylic acids, these are always understood to include both the free acid and metal or ammonium salts of the carboxylic acid. The term carboxyalkyl refers to a $C_1$–$C_4$ alkyl group substituted by one or more carboxyl groups, such as carboxymethyl, carboxyethyl, dicarboxymethyl, 1,2-dicarboxyethyl and the like. The term carboxyacyl refers to a $C_1$–$C_4$ acyl group, in particular a $C_1$–$C_4$ alkanoyl or alkenoyl group substituted by one or more carboxyl groups, such as carboxyacetyl, β-carboxypropionyl, β-carboxyacryloyl, γ-carboxybutyryl, dicarboxyhydroxybutyryl, and the like. As regards the carboxyalkyl and carboxyacyl groups, a preference is expressed for carboxymethyl.

Further, it has been found to be of advantage to use a fructan polycarboxylic acid in combination with an organic acid. The presence of an organic acid has been found to enhance the action of the fructan polycarboxylic acid in the removal of contaminants from textile. As organic acid, preferably glycol acid, diglycol acid or hydroxyacetic acid is used.

According to the invention, textile is treated to remove contaminants present therein. Normally, this involves textile originating from a natural source, such as cotton, wool, jute, silk, linen and the like. However, a method according to the invention can also be practiced in the case of textile based on synthetic fibers, such as polyesters and polyamides. Preferably, cotton, linen or wool are involved.

The contaminants that can be present in the textile will be highly divergent in nature. As stated, frequently occurring contaminants in cotton are sand particles, dust particles and pigment particles, and plant protection agents. However, also during harvesting of the cotton, a number of contaminants, such as defoliants and plant remains, may end up in the textile. As stated, in wool, which originates from an animal source, the contaminants will stem to a large extent from the wool-producing animal itself. In addition, often sand, soil or grass will be present in the wool. The contaminants that can be present in textile based on synthetic fibers will often stem from the equipment used in manufacturing and/or processing the textile. To be considered here are oil used for lubricating apparatus and size present on the warp of a loom for protecting the warp threads. A great advantage of a method according to the invention is further that the fructan polycarboxylic acid used eliminates the adverse effects of hard water (mainly calcium and magnesium ions).

Another contaminant that is removed from textile concerns non-covalently bound, reactive dyestuff. In applying reactive dyestuffs to textile, there occurs to some extent, in addition to the desired reaction whereby the dyestuff is covalently bound to the textile, an undesired hydrolysis reaction which leads to a product that cannot bind covalently to the textile. In addition, there will be a certain amount of reactive dyestuff that does not undergo any reaction at all. This excess dyestuff and the undesired by-product resulting from the hydrolysis referred to in fact constitute contaminants that are to be removed in a rewashing treatment. It has now been found that these contaminants too can be eminently removed in an ecologically sound manner in a method according to the invention.

The present method for removing contaminants from textile can find application in various stages and operations that are carried out in the textile industry. Treatments where good results have been achieved include washing, boiling down, bleaching, dyeing and rewashing. Below, these treatments, and how the present method can be applicable therein, will be discussed by way of example. It will be clear to one skilled in the art that various modifications in the processes mentioned below are possible. Accordingly, the processes described below should not be construed as limiting the invention.

Washing, in most cases, is the first treatment in a textile processing plant carried out on a batch of textile that has been purchased. The treatment applies to all important kinds of textile, in particular to cotton, wool and linen, but also to synthetic fibers.

Cotton can be washed, for instance, to remove contaminants in a washing or dyeing machine of, for instance, 2,000 to 3,000 liters at a temperature between 60 and 100° C. in a liquor ratio of from 1:5 to 1:20 (that is, from 5 to 20 liters of water per kg of textile substrate). Of the fructan polycarboxylic acid, preferably a 25–40% solution is metered in an amount of 0.5–3 g/l of water. Further added to the water are, preferably, alkali, for instance 1–3 g/l of soda or 1–5 g/l of NaOH, and an anionic or a non-ionic detergent, or a combination thereof.

Wool can be washed, for instance, to remove contaminants at a temperature of from 30 to 60° C. in a liquor ratio between 1:5 and 1:20. Of the fructan polycarboxylic acid, preferably a 25–40% solution is metered in an amount of 1–3 g/l of water. It has been found to be of great advantage to add a certain amount of alkali in addition to the fructan polycarboxylic acid. As alkali, 1–3 g/l of soda or 1–3 ml/l of ammonia (25%), or triethanolamine can be used. Further, preferably, also 1–2 g/l of a non-ionic detergent will be used.

In washing linen to remove contaminants, it is of importance not to remove all hardness ions (mainly calcium and magnesium ions), since the fibrils which the long linen fibers form are kept together by calcium pectinate. It has been found that in the present method, this fibril structure is maintained and so-called cottonizing of the linen is prevented. The washing temperature will normally be between 60 and 100° C., while the liquor ratio used is preferably between 1:5 and 1:20. Preferably, a 25–40% solution of the fructan polycarboxylic acid is metered in an amount of 1–4 g/l of water. Depending on the desired feel variations, optionally sodium hydroxide or soda can be used as well, in an amount which can be readily optimized by one skilled in the art. Further, also an anionic or non-ionic detergent, or a mixture of the two, will be used.

Synthetic fibers, such as polyamide or polyester fibers, can be washed to remove contaminants at a temperature of 20–90° C. in a liquor ratio from 1:3 to 1:15. Preferably, a 25–40% solution of the fructan polycarboxylic acid is metered in an amount of 1–2 g/l of water. Although less common in washing synthetic textile, it may be advantageous in certain cases to add 1–2 g/l of soda or sodium hydroxide. Further, preferably 1–2 g/l of a non-ionic detergent is used.

In view of the high temperatures normally used in boiling down textile, this treatment will be applied only to textile that is resistant to high temperatures, such as linen or cotton. The temperature in boiling down cotton is preferably between 90 and 130° C., while preferably 1 to 15 liters of water per kg of textile are used. Boiling down can be carried out in different apparatuses.

If a washing/dyeing machine where the textile is in motion is used, the duration of the, treatment will be between 30 and 90 minutes. Preferably, the treatment then lasts about 60 minutes at a temperature of about 100° C. Preferably, a 25–40% solution of the fructan polycarboxylic acid is metered in an amount of 1–4 g/l of water. In addition, preferably 5–20 g/l of 100% NaOH and 1–2 g/l of a non-ionic or anionic detergent, or a combination thereof, are added.

In a reactor, the textile has been deposited and the liquor moves slowly by means of a pump. The duration of the boiling process in a reactor will be between 4 and 8 hours, at a temperature of preferably about 130° C. Preferably, a 25–40% solution of the fructan polycarboxylic acid is metered in an amount of 2–5 g/l of water. In addition, preferably 10–30 g/l of 100% NaOH and 1–3 g/l of a nonionic or anionic detergent, or a combination thereof, are added.

In a steamer, the liquor is static with respect to the textile. The textile is soaked, pressed between two rollers and then steamed for 2 to 60 minutes, preferably at 100° C. The bath uptake is preferably 100%, that is, 1 liter per kilogram of textile. Preferably, a 25–40% solution of the fructan polycarboxylic acid is metered in an amount of 5–10 g/l of water. In addition, preferably 30–60 g/l of 100% NaOH and 5–10 g/l of a non-ionic or anionic detergent, or a combination thereof, are added.

A next textile treatment where the present method can be applied is bleaching. Bleaching serves to discolor textile by removal of colored constituents through their degradation. Bleaching can take place after a washing process. It is preferred, however, to carry out the bleaching during a washing process, so as to save time, water and energy. Bleaching is a treatment which is especially used in cotton.

When bleaching is carried out discontinuously, for instance in a dynamic washing/dyeing machine, the temperature is preferably 80–110° C. and the treatment takes 30 to 90 minutes. The liquor ratio is preferably between 1:5 and 1:15. Preferably, a 25–40% solution of the fructan polycarboxylic acid is metered in an amount of 0.5–2 g/l of water. In addition, preferably 1–5 g/l of 100% NaOH and 0.5–2 g/l of a detergent are added. Further, in bleaching, a bleaching agent is present. A suitable example of a bleaching agent is a 35% solution of hydrogen peroxide, which is preferably metered in an amount of 2–10 g/l.

When bleaching is carried out continuously, about 1 liter of water per kilogram of textile is used. The temperature during bleaching is then at 90–100° C. and the duration of the treatment is about 2–45 minutes. Preferably, a 25–40% solution of the fructan polycarboxylic acid is metered in an amount of 1–5 g/l of water. In addition, preferably 5–30 g/l of 100% NaOH, 5–10 g/l of a detergent, and 3–10 g/l of a stabilizer, such as water glass or organic stabilizers such as polycarboxylic acids or phosphonates, are added. Further, in bleaching, a bleaching agent is present. A suitable example of a bleaching agent is a 35% solution of hydrogen peroxide, which is preferably metered in an amount of 20–70 g/l.

After bleaching, the textile is preferably rinsed and neutralized with acid. For white textile, often a so-called optical whitening agent, such as a stilbene compound, is used during or after bleaching.

When the present method is part of a textile dyeing process, that dyeing process can be carried out with non-pretreated, pre-washed, boiled down or bleached textile. In this case, the present method should ensure in particular that the dyestuffs used do not become insoluble or experience hindrance in their dyeing behavior as a result of the presence of contaminants. The dyestuffs that can be used in a dyeing process with which the present method can be combined include direct dyestuffs, reactive dyestuffs, vat dyestuffs and metal complex dyestuffs.

Direct dyestuffs are bound to textile through hydrogen bridges and Van der Waals, forces. They are chromophores that possess solubilizing groups, such as sulfate or sulfonate groups. In dyeing with a direct dyestuff, preferably a 25–40% solution of the fructan polycarboxylic acid is metered in an amount of 1–3 g/l of water. In addition, it has been found to be of advantage to carry out the dyeing in the presence of 5–20 g/l of salt, preferably sodium sulfate. The temperature in dyeing is preferably between 80 and 100° C. The duration of the dyeing process is normally between 30 and 60 minutes.

Reactive dyestuffs are small chromophores with a reactive group. The dyestuffs are soluble by virtue of a solubilizing group in the molecule, such as a sulfate or sulfonate group. The reactive group, for instance a vinyl sulfone group, binds covalently to the textile in basic medium and so forms a coloration that is fast to washing. In dyeing with a reactive dyestuff, preferably a 25–40% solution of the fructan polycarboxylic acid is metered in an amount of 1–3 g/l of water. In addition, it has been found to be of advantage to carry out dyeing in the presence of 30–80 g/l of salt, preferably sodium sulfate. In addition, preferably a certain amount of alkali is added. Suitable examples of this are 2–20 g/l of soda, 1–5 g/l of NaOH (100%) and 1–3 g/l of trisodium phosphate. The temperature in dyeing is preferably between 40 and 8° C. The duration of the dyeing process is normally between 60 and 120 minutes.

Vat dyestuffs are anthraquinone- and indigo-like pigments, which, through basic reduction, are brought into solution (the so-called leuco form). In dissolved form, they are added to the textile to be dyed, whereafter the leuco form is undone again through oxidation, which leads to a coloration of a high washing fastness. In this form of dyeing, preferably 25–40% solution of the fructan polycarboxylic acid is metered in an amount of 1–3 g/l of water. In addition, it has been found to be of advantage to carry out the dyeing in the presence of 1–3 g/l of EDTA. Further, preferably 1–10 g/l of NaOH (100%) and 1–3 g/l of dithionite (hydrosulfite) are added. If desired, up to 10 g/l of a salt, preferably sodium sulfate, can be used. The temperature in dyeing is preferably between 40 and 100° C. The duration of the dyeing process is normally between 60 and 120 minutes. As stated, after a dyeing treatment with a vat dyestuff, an oxidation is carried out. This oxidation can proceed in a known manner by the use of peroxide, perborate, percarbonate or oxygen.

Metal complex dyestuffs are used in particular in wool. These substances are chromophores which have been rendered soluble especially with sulfate or sulfonate groups and which also contain metal ions, in particular chromium or copper ions.

What is claimed is:

1. A method of removing contaminant from textile, wherein the textile is a raw material or a semimanufactured product and the textile is treated with an effective amount of a fructan polycarboxylic acid which contains on average at least 0.05 carboxyl groups per monosaccharide unit.

2. A method according to claim 1, wherein the fructan polycarboxylic acid contains on average between 0.5 and 3 carboxyl groups per monosaccharide unit.

3. A method according to claim 1, wherein at least 0.05 of the 3 hydroxymethyl(ene) groups of the fructan on which the fructan polycarboxylic acid is based have been converted into a carboxyl group and at least 0.1 of the 3 hydroxyl groups has been converted into a carboxylakoxy or carboxy-acyloxy group.

4. A method according to claim 3, wherein the hydroxymethyl(ene) groups which have been converted into carboxyl groups and the hydroxyl groups which have been converted into carboxy-alkoxy or carboxy-acyloxy groups are present in the same molecule.

5. A method according to claim 1, wherein the fructan polycarboxylic acid is based on inulin or a derivative thereof.

6. A method according to claim 1, wherein the textile is a natural textile selected from the group consisting of cotton, linen, jute, silk and wool.

7. A method according to claim 1, wherein the method is part of a washing, boiling-down, bleaching, dyeing or rewashing treatment of textile.

8. The method of claim 3, wherein at least 0.2 to 2.0 of the 3 hydroxymethyl(ene) groups of the fructan on which the fructan polycarboxylic acid is based have been converted into a carboxyl group.

9. The method of claim 3, wherein at least 0.3 to 2.0 of the 3 hydroxyl groups has been converted into a carboxy-alkoxy or carboxy-acyloxy group.

10. A method of removing contaminants from textiles, comprising contacting a textile with an effective amount of a fructan polycarboxylic acid, wherein the fructan polycarboxylic acid is carboxymethyl inulin.

11. The method of claim 10, wherein said contacting is carried out during washing, boiling off, bleaching, dying or rewashing of said textile.

12. The textile treated by the method of claim 10.

13. The method of claim 1, wherein said fructan polycarboxylic acid is based on fructans having a chain length of at least 10.

14. The method of claim 10, wherein said fructan polycarboxylic acid is based on fructans having a chain length of at least 10.

15. The textile treated by the method of claim 1.

* * * * *